US011352184B2

(12) United States Patent
Tsuchiya et al.

(10) Patent No.: US 11,352,184 B2
(45) Date of Patent: Jun. 7, 2022

(54) CONTAINER

(71) Applicant: NISSEI ASB MACHINE CO., LTD., Nagano (JP)

(72) Inventors: Yoichi Tsuchiya, Nagano (JP); Yukihiro Uehara, Nagano (JP)

(73) Assignee: NISSEI ASB MACHINE CO., LTD., Nagano (JP)

( * ) Notice: Subject to any disclaimer, the term of this patent is extended or adjusted under 35 U.S.C. 154(b) by 0 days.

(21) Appl. No.: 16/977,733

(22) PCT Filed: Mar. 5, 2019

(86) PCT No.: PCT/JP2019/008679
§ 371 (c)(1),
(2) Date: Sep. 2, 2020

(87) PCT Pub. No.: WO2019/172267
PCT Pub. Date: Sep. 12, 2019

(65) Prior Publication Data

US 2021/0061534 A1 Mar. 4, 2021

(30) Foreign Application Priority Data

Mar. 5, 2018 (JP) ..... JP2018-039065

(51) Int. Cl.
*B65D 79/00* (2006.01)
*B65D 1/42* (2006.01)
*B65D 1/02* (2006.01)

(52) U.S. Cl.
CPC ..... *B65D 79/0081* (2020.05); *B65D 1/0207* (2013.01); *B65D 1/0276* (2013.01); *B65D 1/42* (2013.01); *B65D 2501/0036* (2013.01)

(58) Field of Classification Search
CPC .. B65D 1/0276; B65D 1/0261; B65D 79/005; B65D 2501/0018; B65D 89/0081
See application file for complete search history.

(56) References Cited

U.S. PATENT DOCUMENTS 4,261,948 A 4/1981 Krishnakumar et al.
4,334,627 A 6/1982 Krishnakumar et al.
(Continued)

FOREIGN PATENT DOCUMENTS

CN 101980922 A 2/2011
CN 102612469 A 7/2012
(Continued)

OTHER PUBLICATIONS

International Search Report issued in International Patent Application No. PCT/JP2019/008679, dated May 28, 2019 and English Translation thereof.
(Continued)

*Primary Examiner* — Andrew T Kirsch
(74) *Attorney, Agent, or Firm* — Greenblum & Bernstein, P.L.C.

(57) ABSTRACT

A container is configured so that a bottom section has a ground contact section provided to the outer periphery of a body section, and a raised bottom section provided inside the ground contact section and deformed in accordance with a change in inner pressure; the raised bottom section is provided with an upper surface section provided at the center, and a connection section which connects the upper surface section and the ground contact section; the connection section is formed so that, when the inner pressure is normal pressure, the upper surface section-side end of the connection section is positioned closer to a neck section than the ground contact section-side end of the connection section; and at least the connection section of the bottom section is provided with a reinforcement section which extends in the radial direction of the bottom section and reinforces the bottom section.

5 Claims, 7 Drawing Sheets

(56) References Cited

U.S. PATENT DOCUMENTS

| | | | |
|---|---|---|---|
| 4,525,401 | A | 6/1985 | Pocock et al. |
| 4,603,831 | A | 8/1986 | Krishnakumar et al. |
| 4,620,639 | A | 11/1986 | Yoshino |
| 4,977,005 | A | 12/1990 | Krishnakumar et al. |
| 5,080,244 | A | 1/1992 | Yoshino |
| 5,116,565 | A | 5/1992 | Yoshino |
| 2009/0242575 | A1 | 10/2009 | Kamineni et al. |
| 2010/0219152 | A1 | 9/2010 | Derrien et al. |
| 2011/0233166 | A1 | 9/2011 | Hiromichi et al. |
| 2012/0248059 | A1 | 10/2012 | Saito et al. |
| 2012/0248060 | A1 | 10/2012 | Saito et al. |
| 2013/0180943 | A1 | 7/2013 | Kurihara |
| 2013/0240477 | A1 | 9/2013 | Saito et al. |
| 2014/0048508 | A1 | 2/2014 | Kamineni et al. |
| 2014/0209558 | A1 | 7/2014 | Wright et al. |
| 2016/0167824 | A1 | 6/2016 | Wright et al. |
| 2018/0327133 | A1 | 11/2018 | Howell et al. |

FOREIGN PATENT DOCUMENTS

| | | | |
|---|---|---|---|
| CN | 206634327 | U | 11/2017 |
| EP | 0029639 | A1 | 3/1981 |
| EP | 2612820 | | 7/2013 |
| JP | 55-64039 | A | 5/1980 |
| JP | 3-14618 | B2 | 2/1991 |
| JP | 2007269392 | A | 10/2007 |
| JP | 2010-535137 | A | 11/2010 |
| JP | 5316940 | B2 | 7/2013 |
| JP | 2016-506895 | A | 3/2016 |
| JP | 2016-145074 | A | 8/2016 |
| WO | 2015126404 | | 8/2015 |
| WO | 2016060680 | | 4/2016 |
| WO | 2016/121890 | A1 | 8/2016 |

OTHER PUBLICATIONS

Written Opinion of the International Search Authority issued in International Patent Application No. PCT/JP2019/008679, dated May 28, 2019 and English Translation thereof.

CN First Office Action in corresponding Application 201980025855.0 dated Sep. 7, 2021.

Extended European Search Report dated Nov. 5, 2021 in the Corresponding European Patent Application No. 19764407.3.

A–A′

B–B′

C-C′

(a)

D-D′

(b)

E-E′

CONTAINER

TECHNICAL FIELD

The present invention relates to a resin container having heat resistance.

BACKGROUND ART

There is known a container which is blow-molded using polyethylene terephthalate (PET) as resin. A PET container is excellent in transparency, strength, hygiene, etc., and is used as a container for various contents. In particular, the PET container is now widely used as a container for storing liquid substances such as beverages. Recently, the use of the PET container has been further expanded, and a wide-mouth container for storing semi-solids such as jam and pasta sauce is also beginning to appear. Further, a heat-resistant container, which is one of the PET containers, can be filled with foods and beverages that have been heated to high temperature for sterilization.

In this type of container, the contents sterilized by heating at high temperature of, for example, about 90° C. may be filled in the high temperature, sealed with a lid, and then, cooled. During this cooling, there is a possibility that the interior of the container becomes a decompressed atmosphere as the volume of the contents decreases, and the body portion of the container is irregularly deformed. The irregular deformation of the body portion can be suppressed by intentionally providing a part of the body portion of the container with uneven portions that deform due to the decompression. However, the surface on which a product label is attached becomes uneven, which is not preferable.

Further, in order to suppress the irregular deformation of the body portion, a structure for absorbing deformation due to the decompression inside the container is provided on a bottom surface of the container. For example, there is a container in which a recessed portion formed by recessing a bottom surface wall inward of a bottle body made of synthetic resin is provided on a bottom surface of a bottom portion of the bottle body so that the recessed portion can be deformed to be recessed inward of the bottle body during decompression (see PTL 1). In this way, by providing the structure for absorbing the decompression inside the container on a portion other than the body portion, it becomes unnecessary to provide uneven portions on the body portion. Therefore, options for the shape, attachment position, and the like of the product label are increased, and the flexibility of the container design is improved.

Meanwhile, some of the contents to be filled in the container are not suitable for filling at high temperature as described above. For example, when the contents are food such as pickles, the quality of the contents may deteriorate when the contents themselves are sterilized at high temperature before filling.

In this case, for example, the quality deterioration of the contents can be suppressed by filling the container with the contents before sterilization at high temperature, sealing the container, and then, sterilizing the contents with the container at high temperature under predetermined conditions.

However, when the contents are sterilized with the container at high temperature in this way, the internal pressure of the container may increase due to the temperature rise of the contents, and the container may be deformed. For example, in the container (bottle body) disclosed in PTL 1, the bottle body can be deformed to be recessed inward when the internal pressure of the bottle body (container) shifts from a normal pressure state to a decompressed state (negative pressure), but the deformation of the bottle body (bottom portion) when the internal pressure shifts from a normal pressure state to a pressurized state (positive pressure) is not considered.

Further, in order to deform the bottom portion of the container and suppress the deformation of the body portion when the internal pressure of the container increases, for example, it is conceivable to reduce the thickness of the bottom portion of the container and allow the bottom portion of the container to be easily deformed. In this case, when the thickness of the bottom portion of the container is reduced and the rigidity of the bottom portion becomes too low, there is a possibility that the bottom portion of the container may be deformed more than necessary due to an increase in the internal pressure of the container.

Therefore, it is necessary to appropriately adjust the rigidity of the bottom portion of the container. However, it is difficult to appropriately adjust the rigidity of the bottom portion of the container only by changing the overall thickness of the bottom portion of the container. Furthermore, it is necessary to design the shape of the bottom portion of the container by estimating the magnitude of the internal pressure fluctuation (the magnitude of the volume change of the contents) while taking into account the strength. However it is very difficult to appropriately design the shape of the bottom portion of the container from the beginning.

Thus, in order to increase the rigidity of the bottom portion of the container, there is a container in which ribs are provided on the bottom portion of the container and the bottom portion is reinforced by the ribs (e.g., see PTL 2).

CITATION LIST

Patent Literature

PTL 1: JP-B-5316940
PTL 2: JP-B2-H3-14618

SUMMARY OF INVENTION

Technical Problem

When the ribs (reinforcement portions) are provided on the bottom portion of the container as disclosed in PTL 2, the rigidity of the bottom portion can be increased and the rigidity of the bottom portion of the container can be easily adjusted.

However, simply by providing the reinforcement portions (ribs) on the bottom portion of the container, the rigidity of the bottom portion of the container cannot be appropriately adjusted when the pressure fluctuation inside the container occurs, for example, when the internal pressure of the container shifts from a normal pressure state to a pressurized state (positive pressure).

The present invention has been made in view of such circumstances, and an object thereof is to provide a container capable of suppressing deformation of a bottom portion caused by internal pressure fluctuation and maintaining good aesthetic appearance.

Solution to Problem

One aspect of the present invention for solving the above problem is a container made of resin, the container including: a neck portion that is opened; a tubular body portion; and a bottom portion sealing one end side of the body portion, in which the bottom portion includes a ground contact portion provided on an outer peripheral part of the body portion and a raised bottom portion provided on an inner side of the ground contact portion and configured to deform according to a change in internal pressure, the raised bottom portion includes an upper surface portion provided in a central part thereof and a connecting portion that connects the upper surface portion and the ground contact portion, and at least the connecting portion of the bottom portion is provided with a reinforcement portion that extends in a radial direction of the bottom portion and reinforces the bottom portion.

According to the present invention, the reinforcement portion enhances the rigidity of the raised bottom portion, in particular, the connecting portion. Therefore, by providing the reinforcement portion with a predetermined shape, the shape of the bottom portion including the raised bottom portion can be appropriately maintained even when pressure fluctuation in the container occurs.

Here, it is preferable that the connecting portion is formed such that an end portion of the connecting portion on the upper surface portion side is located closer to the neck portion than an end portion of the connecting portion on the ground contact portion side in a state where the internal pressure is a normal pressure. With this configuration, the shape of the bottom portion including the raised bottom portion can be more appropriately maintained even when the internal pressure of the container increases.

Further, it is preferable that the reinforcement portion is a rib protruding from an inner surface of the bottom portion. With this configuration, the rigidity of the bottom portion can be appropriately increased, and good appearance can be maintained.

Further, it is preferable that the bottom portion is provided with a plurality of the reinforcement portions which extend radially from a central part of the bottom portion toward an outer peripheral part of the bottom portion.

Further, it is preferable that the reinforcement portion includes a main body portion provided in the connecting portion, a first extension portion continuous from the main body portion and extending to the upper surface portion, and a second extension portion continuous from the main body portion and extending to the ground contact portion.

Further, it is preferable that a thickness of the first extension portion and a thickness of the second extension portion are thinner than a thickness of the main body portion.

Further, it is preferable that a width of the first extension portion and a width of the second extension portion are narrower than a width of the main body portion.

When the reinforcement portion is formed to have a predetermined shape in this way, the shape of the bottom portion including the raised bottom portion can be more appropriately maintained when pressure fluctuation in the container occurs.

Advantageous Effects of Invention

As described above, according to the container of the present invention, since the rigidity of the bottom portion including the raised bottom portion is increased, the deformation of the bottom portion is suppressed even when internal pressure fluctuation (e.g., pressure rise) occurs. For example, the pressure in the container changes due to the temperature change of the contents when the container is sterilized together with the contents at the high temperature. Also in that case, the deformation of the bottom portion due to the internal pressure fluctuation can be efficiently suppressed.

DESCRIPTION OF EMBODIMENTS

Hereinafter, an embodiment of the present invention will be described in detail with reference to the drawings.

First Embodiment

Figure 1:
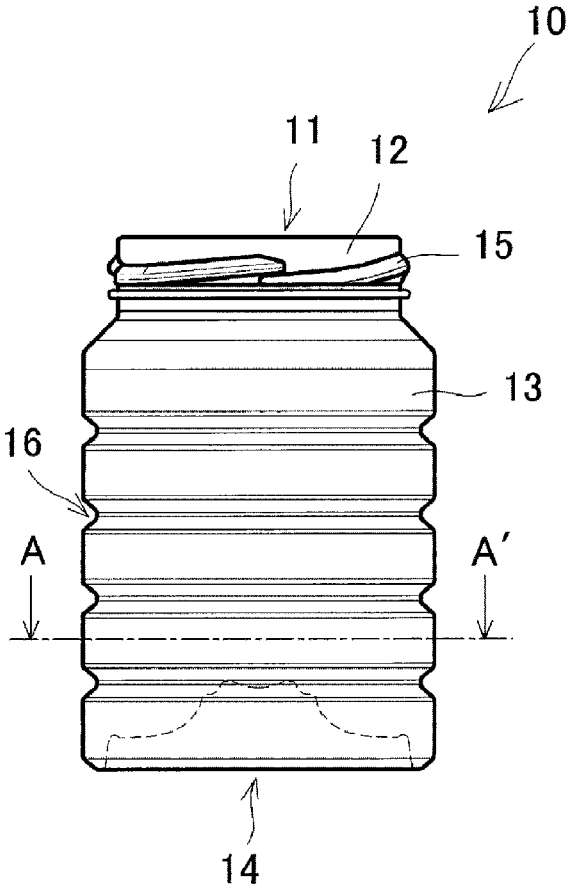
FIG. 1 is a front view of a container according to a first embodiment of the present invention.
Figure 2:
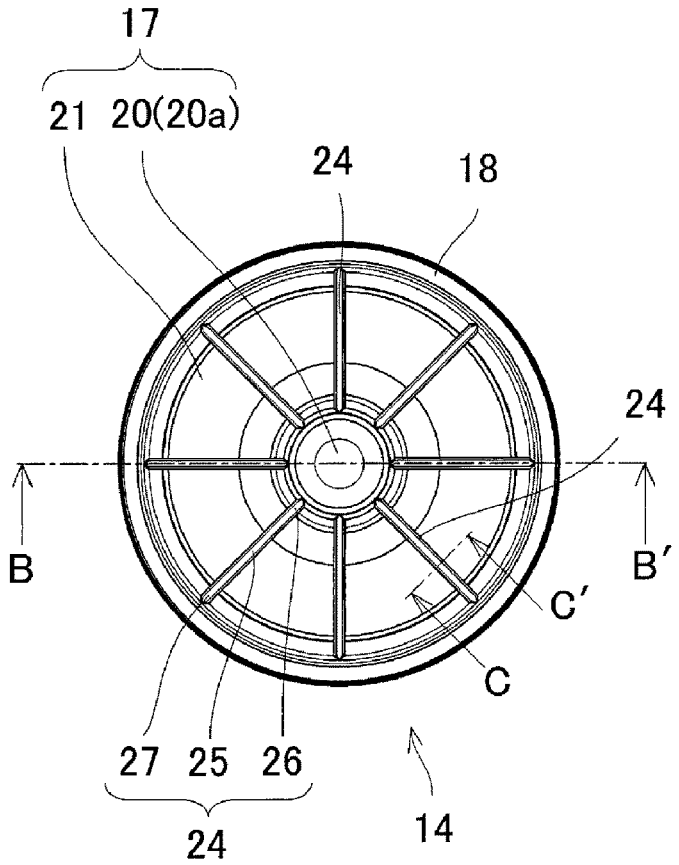
FIG. 2 is a view showing a bottom portion of the container according to the first embodiment of the present invention.
Figure 3:
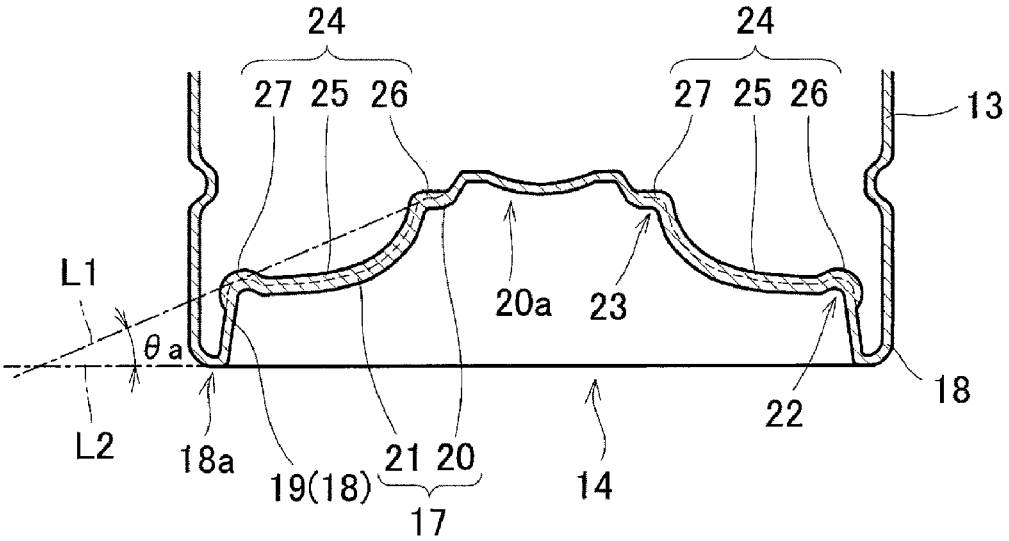
FIG. 3 is a view showing the bottom portion of the container according to the first embodiment of the present invention.
Figure 4:
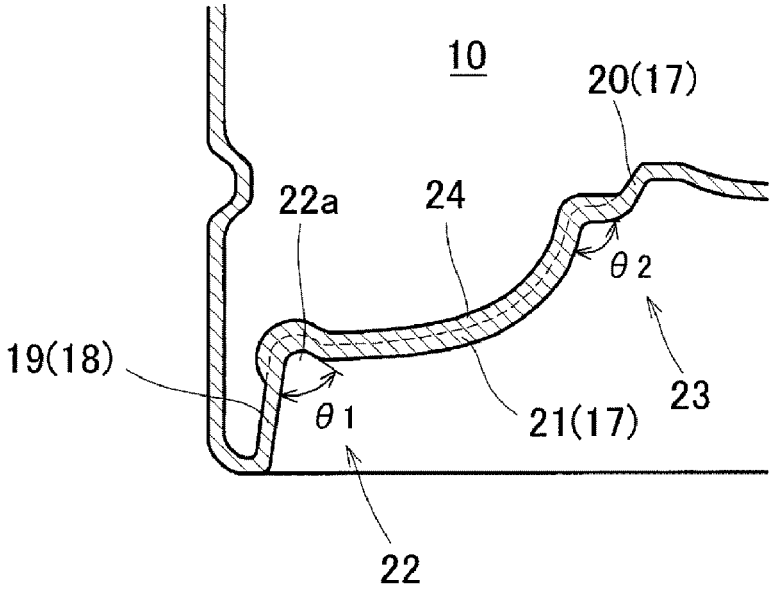
FIG. 4 is an enlarged view showing the bottom portion of the container according to the first embodiment of the present invention.
Figure 5:
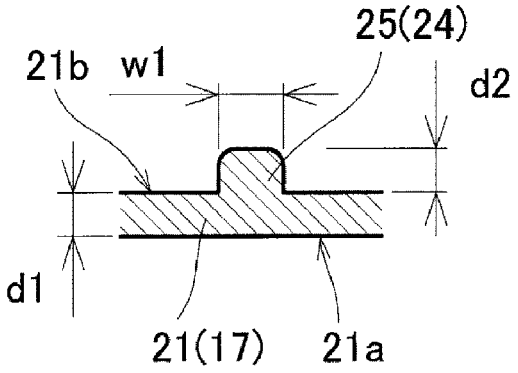
FIG. 5 is a cross-sectional view showing a reinforcement portion according to the first embodiment of the present invention.

FIG. 1 is a front view of a container according to a first embodiment of the present invention, and FIG. 2 is a view showing a bottom surface of the container and is a cross-sectional view taken along the line A-A' in FIG. 1. Further, FIGS. 3 and 4 are views showing the shapes of the bottom portion of the container. FIG. 3 is a cross-sectional view taken along the line B-B' in FIG. 2, and FIG. 4 is a partially enlarged cross-sectional view thereof. FIG. 5 is a cross-sectional view showing a reinforcement portion according to the first embodiment of the present invention and is a cross-sectional view taken along the line C-C' in FIG. 2.

As shown in FIG. 1, a container (heat-resistant container) 10 according to the present embodiment includes a tubular neck portion 12 having a wide opening 11 on one end side (upper end side), a tubular body portion 13 connected to the neck portion 12, and a bottom portion 14 continuing from the body portion 13. The container 10 is a container made of resin such as polyethylene terephthalate (PET). For example, the container 10 is filled with food such as pickles (including liquid) as the content. Although the size of the container 10 is not particularly limited, in the present embodiment, the diameter of the body portion 13 is formed to be about 70 mm.

The neck portion 12 is formed with a screw portion 15 to which a cap (not shown) is screwed. The body portion 13 is provided with a plurality of (e.g., five) concave ribs 16 continuous in a peripheral direction of the body portion 13 in a height direction of the body portion 13. Thereby, the rigidity of the body portion 13 is enhanced.

The container 10 is formed by biaxially stretching and blowing a preform. That is, the container 10 is formed by biaxially stretching and blowing the portion other than the neck portion 12. High heat resistance is imparted to the portion of the container 10 other than the neck portion 12 by crystallization according to heat setting and the action of removing internal stress. Further, it is desirable that heat resistance is also imparted to the neck portion 12 by white crystallization.

As shown in FIGS. 2 to 5, the bottom portion 14 that closes the bottom of the body portion 13 has a raised bottom portion 17 formed by recessing a center part of the body portion 13 inward, and a ground contact portion 18 provided on an outer peripheral part of the raised bottom portion 17. The raised bottom portion 17 refers to a portion that is provided to close the center side of the body portion 13 with respect to a rising portion 19 that forms an inner surface of the ground contact portion 18. Further, the ground contact portion 18 refers to a portion where a ground contact surface 18*a* is formed to be in contact with a stand, for example, when the container 10 is placed on the stand with the opening 11 facing upward. In the present embodiment, the ground contact portion 18 is a portion on an outer side of the rising portion 19.

Further, the rising portion 19 is configured to be slightly inclined inward with respect to the surface of the stand in a state where the container 10 is placed on the stand. That is, the rising portion 19 is configured to be slightly inclined inward with respect to the ground contact surface 18*a* of the ground contact portion 18 and does not stand upright with respect to the ground contact surface 18*a*.

Further, the raised bottom portion 17 has an upper surface portion 20 provided at a center part of the bottom portion 14 and a connecting portion 21 that connects the upper surface portion 20 and the rising portion 19. The upper surface portion 20 is a portion that forms an upper surface of the raised bottom portion 17. In the present embodiment, a concave portion 20*a* that is slightly recessed is formed at a center part of the upper surface portion 20.

The connecting portion 21 is formed into a curved surface that makes the outer side of the container 10 convex in a state where the internal pressure is a normal pressure (approximately atmospheric pressure). Furthermore, the connecting portion 21 is formed such that an end portion on the upper surface portion 20 side is located closer to the neck portion 12 (the inner side of the body portion 13: the upper side in FIG. 3) than an end portion on the ground contact portion 18 side in a state where the internal pressure of the container 10 is the normal pressure.

In other words, in a state where the internal pressure of the container 10 is the normal pressure, a second corner portion 23 formed by the connecting portion 21 and the upper surface portion 20 is located closer to the neck portion 12 (the inner side of the body portion 13: the upper side in FIG. 3) than a first corner portion 22 formed by the connecting portion 21 and the rising portion 19. Therefore, a straight line L1 connecting the first corner portion 22 and the second corner portion 23 is inclined at a predetermined angle θa with respect to a straight line L2 extending from the ground contact surface 18*a* of the ground contact portion 18.

Further, as shown in FIG. 4, an angle θ1 of the first corner portion 22 formed by the connecting portion 21 and the rising portion 19 is set to be smaller than an angle θ2 of the second corner portion 23 formed by the connecting portion 21 and the upper surface portion 20. In the present embodiment, the first corner portion 22 has a depression portion 22*a* formed by recessing a part thereof (mainly, the connecting portion 21) toward the inner side of the container 10. As a result, the angle θ1 of the first corner portion 22 is smaller than the angle θ2 of the second corner portion 23. In this way, the first corner portion 22 is further configured to be more easily bent than the second corner portion 23. It is not essential to provide the depression portion 22*a*.

Further, it is preferable that an angle θa of the straight line L1 to the straight line L2, the angle θ1 of the first corner portion 22, and the angle θ2 of the second corner portion 23 satisfy the relationship of $\theta a<\theta 1<\theta 2$ in a state where the internal pressure of the container 10 is the normal pressure.

Further, reinforcement portions 24 that extend in a radial direction of the bottom portion 14 and reinforce the bottom portion 14 are formed at least in the connecting portion 21 of the raised bottom portion 17 constituting the bottom portion 14. The reinforcement portions 24 are formed of ribs protruding from the inner surface of the bottom portion 14 and enhance the rigidity of the bottom portion 14.

Although the shape and arrangement of the reinforcement portion 24 are not particularly limited, for example, a plurality of (in the present embodiment, eight at intervals of 45 degrees) reinforcement portions 24, which are ribs protruding from the inner surface, are provided on the bottom portion 14 radially from the center of the bottom portion 14. Naturally, the number of the reinforcement portions 24 is not particularly limited, and may be 7 or less or 9 or more.

Further, the raised bottom portion 17 is formed to have substantially the same thickness d1 except for the reinforcement portions 24 (see FIG. 5), and by providing the reinforcement portions 24, the raised bottom portion 17 is formed in a predetermined shape so that each part of the raised bottom portion 17 has appropriate rigidity.

As shown in FIG. 5, when viewed in a cross section (C-C' cross section) orthogonal to the extending direction of the reinforcement portion 24, an outer wall surface 21*a* of the connecting portion 21 forming the raised bottom portion 17 is flush. On the other hand, since an inner wall surface 21*b* of the connecting portion 21 is provided with a plurality of reinforcement portions 24, the inner wall surface 21*b* is an uneven surface. That is, the portions where the reinforcement portions 24 are provided become convex, and the portions where the reinforcement portions 24 are not provided become concave. In other words, the portions of the connecting portion 21 where the reinforcement portions 24 are provided are thicker than the portions where the reinforcement portions 24 are not provided.

Each of the reinforcement portions 24 is formed to have a predetermined thickness d2 and a predetermined width w1 which are set in advance so that the connecting portion 21 has appropriate rigidity. For example, in the present embodiment, while the thickness d1 of the connecting portion 21 (the raised bottom portion 17) is about 0.4 mm to 0.5 mm, the thickness d2 of each reinforcement portion 24 is about 0.5 mm to 1.0 mm, and the width w1 is about 1.5 mm to 2.0 mm.

Further, in the present embodiment, each reinforcement portion 24 is continuously provided from the connecting portion 21 to the first corner portion 22 and the second corner portion 23. That is, each reinforcement portion 24 is continuously formed from the connecting portion 21 to a part of the upper surface portion 20 and the ground contact portion 18 (the rising portion 19).

In other words, the reinforcement portion 24 includes a main body portion 25 provided in the connecting portion 21, a first extension portion 26 that continuously extends from the main body portion 25 to the upper surface portion 20, and a second extension portion 27 that continuously extends from the main body portion 25 to the ground contact portion 18 (the rising portion 19).

Since the reinforcement portions 24 having predetermined shapes are provided in the bottom portion 14 of the container 10 as described above, the rigidity of the raised bottom portion 17 is appropriately adjusted. Therefore, in the container 10 according to the present embodiment, for example, when pressure fluctuation occurs in the container 10 (e.g., internal pressure rises), swelling deformation (reversal deformation), irregular deformation and the like of the raised bottom portion 17 are suppressed, and the bottom portion 14 of the container 10 is appropriately deformed. In this way, the good appearance of the container 10 can be maintained.

Specifically, each reinforcement portion 24 is continuously formed from the connecting portion 21 to a part of the upper surface portion 20 and the ground contact portion 18 (the rising portion 19). That is, each reinforcement portion 24 includes the main body portion 25, and the first extension portion 26 and the second extension portion 27 which are continuous from the main body portion 25.

In this way, the rigidity of the first corner portion 22 is increased, but is relatively slightly lower than the rigidity of the connecting portion 21. Since the reinforcement portions 24 are provided radially from a central part, the distance between the reinforcement portions 24 increases toward the outer side of the container 10. Therefore, the rigidity of the first corner portion 22 located on the outer side of the connecting portion 21 is relatively slightly lower than the rigidity of the connecting portion 21. Furthermore, the first corner portion 22 can be more easily bent than the second corner portion 23 as described above.

Therefore, when pressure fluctuation occurs in the container 10 (when internal pressure rises), the raised bottom portion 17 is configured such that the first corner portion 22 is mainly deformed and the deformation amount of the second corner portion 23 is extremely small. That is, the deformation amount of the connecting portion 21 and the upper surface portion 20 is extremely small (these portions are not substantially deformed). In this way, the good appearance of the container 10 can be maintained.

In the present embodiment, each reinforcement portion 24 is formed to have substantially the same thickness along the length direction thereof, but the thickness of the reinforcement portion 24 is not particularly limited. For example, the thickness of the first extension portion 26 and the thickness of the second extension portion 27 may be smaller than the thickness of the main body portion 25.

Further, the ribs forming the reinforcement portions 24 are preferably provided on the inner surface of the container 10 (the bottom portion 14). That is, it is preferable that the reinforcement portions 24 are not provided on the outer surface of the container 10. Thereby, the aesthetic appearance of the container 10 can be further improved. Furthermore, the moldability of the container 10 can be also improved.

If the reinforcement portions (ribs) 24 are to be provided on the outer surface of the container 10, there is a possibility that some portions may be difficult to be stretched in a lateral direction depending on the contact state with a mold (bottom mold) at the time of molding. As a result, the formation areas of the reinforcement portions 24 may be small or the lengths thereof may be uneven.

Figure 6:
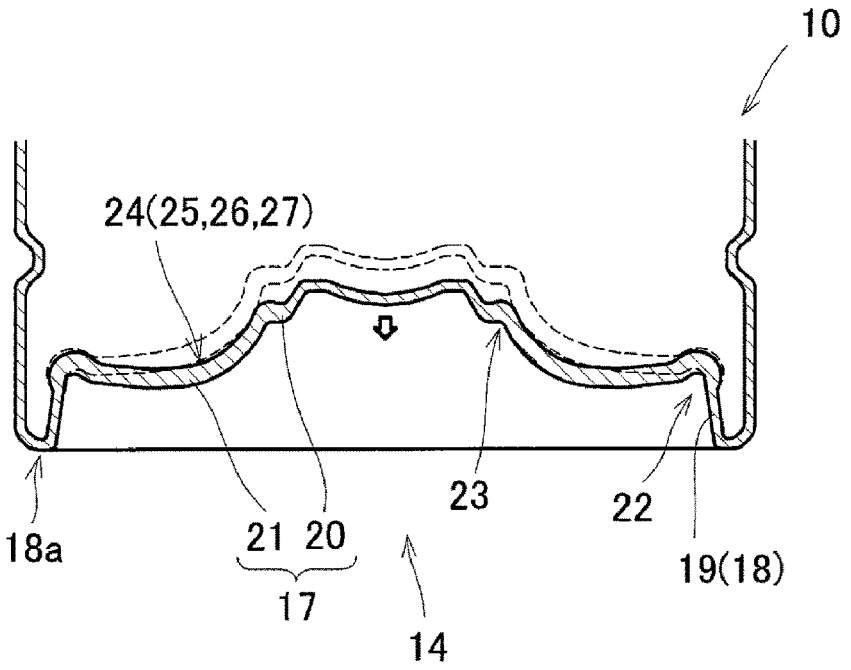
FIG. 6 is a view for explaining deformation of the bottom portion of the container according to the first embodiment of the present invention.

Here, the deformed state of the raised bottom portion 17 due to the change in the internal pressure of the container 10 will be described in more detail with reference to FIG. 6.

For example, when filling the food contents such as pickles (including liquid) into the container 10, in order to suppress the deterioration of quality, the contents whose temperature is controlled at about 10° C. to 40° C. are filled into the container 10 and the opening 11 is sealed with a cap (not shown). Thereafter, the container 10 may be heated with a high-temperature medium of, for example, about 85° C. to 95° C. for a predetermined time (about 30 minutes), such that the contents are sterilized together with the inside of the container 10 (including the inner surface area of the cap). Even when the sterilization process is performed at such a high temperature, the volume of the contents and the like may increase with the temperature rise, and the pressure in the container 10 may fluctuate (rise).

When the reinforcement portions 24 are provided as described above, the rigidity of the first corner portion 22 is relatively slightly lower than the rigidity of the connecting portion 21. Therefore, when the internal pressure of the container 10 rises, for example, as shown in FIG. 6, the raised bottom portion 17 is displaced to the outer side of the container 10 (lower side in the drawing) with mainly the first corner portion 22 as a base point, but the deformation amount of the connecting portion 21 and the upper surface portion 20 is small.

In this way, the raised bottom portion 17 is slightly deformed as the internal pressure of the container 10 increases, so that the increase in the internal pressure of the container 10 is suppressed (preferably, absorbed). Here, since the deformation amount of the connecting portion 21 and the upper surface portion 20 at that time is small, the good appearance of the container 10 can be maintained.

Further, in the present embodiment, as described above, the second corner portion 23 is located closer to the inner side of the container 10 (the neck portion 12 side) than the first corner portion 22 in a state where the inside of the container 10 is the normal pressure. That is, the connecting portion 21 constituting the raised bottom portion 17 is provided to be inclined at a predetermined angle θ with respect to the ground contact surface 18*a*. Therefore, the raised bottom portion 17 can be more easily deformed with the first corner portion 22 as a base point.

Further, the connecting portion 21 is formed into a curved surface that makes the outer side of the container 10 convex in a state where the internal pressure is the normal pressure. In this way, the raised bottom portion 17 is unlikely to deform. Further, even when the internal pressure of the container 10 increases, the deformation of the raised bottom portion 17 is suppressed. Therefore, the good appearance of the container 10 can be maintained.

Thereafter, when high-temperature sterilization of the container 10 and contents is completed, the container 10 is cooled to room temperature. As the temperature of the contents decreases, the internal pressure of the container 10 is reduced and drops to the normal pressure (approximately atmospheric pressure). Further, when the internal pressure drops, the raised bottom portion 17 is displaced to its original position indicated by the dotted line in FIG. 6.

As described above, the bottom portion 14 of the container 10 according to the present invention has a function of suitably maintaining its shape against and withstanding the internal pressure fluctuation (specifically, transition of internal pressure in which pressure rises from the normal pressure, peak pressure is maintained for a predetermined time, and then, pressure drops) of the container 10 caused by the high-temperature sterilization process after sealing.

By the way, the shapes and sizes of the reinforcement portion 24 provided on the bottom portion 14 are not particularly limited, and may be appropriately determined so that each portion (in particular, the connecting portion 21, the first corner portion 22 and the second corner portion 23) of the bottom portion 14 has desired rigidity. For example, the reinforcement portion 24 may be provided only on the connecting portion 21. That is, the reinforcement portion 24 may be configured only by the main body portion 25.

Second Embodiment

Figure 7:
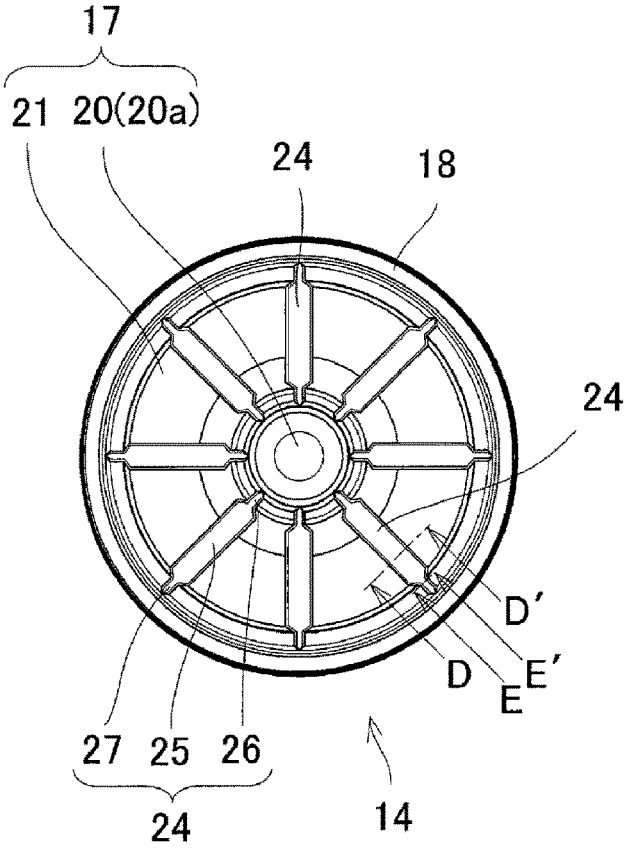
FIG. 7 is a view showing a bottom portion of a container according to a second embodiment of the present invention.
Figure 8:
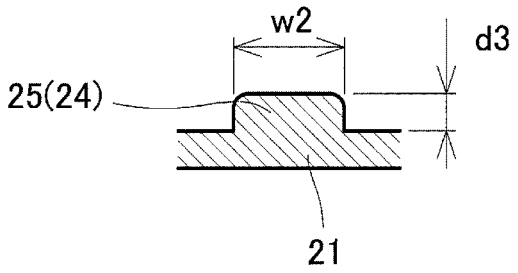
FIG. 8 is a cross-sectional view showing a reinforcement portion according to the second embodiment of the present invention.
Figure 8:
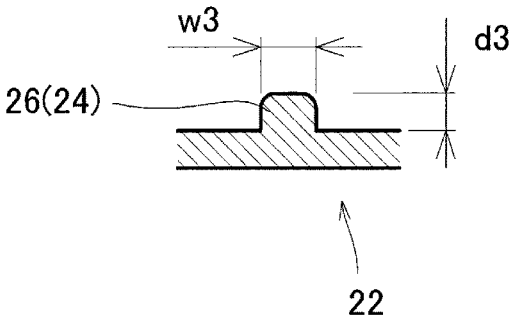

FIG. 7 is a view showing a bottom portion of a container according to a second embodiment. FIG. 8 is a cross-sectional view showing a reinforcement portion according to the second embodiment. (a) of FIG. 8 is a cross-sectional view taken along the line D-D' in FIG. 7, and (b) of FIG. 8 is a cross-sectional view taken along the line E-E' in FIG. 7.

As shown in FIGS. 7 and 8, in the present embodiment, the main body portion 25 constituting each reinforcement portion 24 is formed to have a predetermined width w2 set in advance so that the connecting portion 21 has appropriate rigidity.

The first extension portion 26 has a width (a predetermined width w3 set in advance) narrower than that of the main body portion 25 and is provided continuously from the main body portion 25 at the portion corresponding to the first corner portion 22. That is, the first extension portion 26 is provided to have a length reaching the rising portion 19 from the connecting portion 21.

Similarly to the first extension portion 26, the second extension portion 27 has a width (the predetermined width w3 set in advance) narrower than that of the main body portion 25 and is provided continuously from the main body portion 25 at the portion corresponding to the second corner portion 23. That is, the second extension portion 27 is provided to have a length reaching the upper surface portion 20 from the connecting portion 21.

In other words, the main body portion 25 of the reinforcement portion 24 is provided to have a length that does not reach the first corner portion 22 and the second corner portion 23. That is, the first corner portion 22 and the second corner portion 23 are not provided with the main body portion 25 that is wider than the first extension portion 26 and the second extension portion 27.

In the present embodiment, the first extension portion 26 and the second extension portion 27 are formed to have the width w3 that is about ½ of the width of the main body portion 25. Although the first extension portion 26 and the second extension portion 27 are formed to have the same width w3, the widths of the first extension portion 26 and the second extension portion 27 do not necessarily need to be the same. Further, the first extension portion 26 and the second extension portion 27 may be provided as needed, and either one may be provided or none of them may be provided.

Further, in the present embodiment, the main body portion 25 is formed to have a predetermined thickness d3 set in advance, and the thickness (height) of the first extension portion 26 and the second extension portion 27 is set to be the same as the thickness d3 of the main body portion 25. The thickness of the first extension portion 26 and the second extension portion 27 may be appropriately determined, and may be smaller than the thickness d3 of the main body portion 25.

Although, in the present embodiment, the portion of the raised bottom portion 17 other than the reinforcement portions 24 is formed to have a thickness that is substantially uniform with the ground contact portion 18, the thickness of the raised bottom portion 17 other than the reinforcement portions 24 is not particularly limited. For example, the raised bottom portion 17 may be formed to be slightly thinner than the ground contact portion 18.

As described above, in the present embodiment, the bottom portion 14 of the container 10 is provided with the reinforcement portions 24 each including the main body portion 25 having the predetermined width w2 and the first extension portion 26 and the second extension portion 27 having the width w3 narrower than the main body portion 25, so that the rigidity of the raised bottom portion 17 can be adjusted appropriately. Specifically, since the main body portion 25 having the predetermined width w2 (>w3) is provided, the rigidity of the connecting portion 21 can be sufficiently increased. On the other hand, since the first corner portion 22 and the second corner portion 23 have the predetermined width w3 (<w2), the rigidity of the first corner portion 22 and the second corner portion 23 is not excessively increased and becomes appropriate.

Further, in the container 10 of the present embodiment as described above, the deformation of the bottom portion 14 due to the internal pressure fluctuation is suppressed, and the good aesthetic appearance can be maintained. Specifically, swelling deformation (reversal deformation) and irregular deformation of the raised bottom portion 17 due to the fluctuation of the internal pressure can be suppressed.

As described above, the bottom portion 14 of the container 10 according to the present embodiment has a function of suitably maintaining its shape against and withstanding the internal pressure fluctuation (specifically, transition of internal pressure in which pressure rises from the normal pressure, peak pressure is maintained for a predetermined time, and then, pressure drops) of the container 10 caused by the high-temperature sterilization process after sealing.

Also in the present embodiment, the shapes and sizes of the reinforcement portion 24 provided on the bottom portion 14 are not particularly limited, and may be appropriately determined so that each portion (in particular, the connecting portion 21, the first corner portion 22 and the second corner portion 23) of the bottom portion 14 has desired rigidity.

Figure 9:
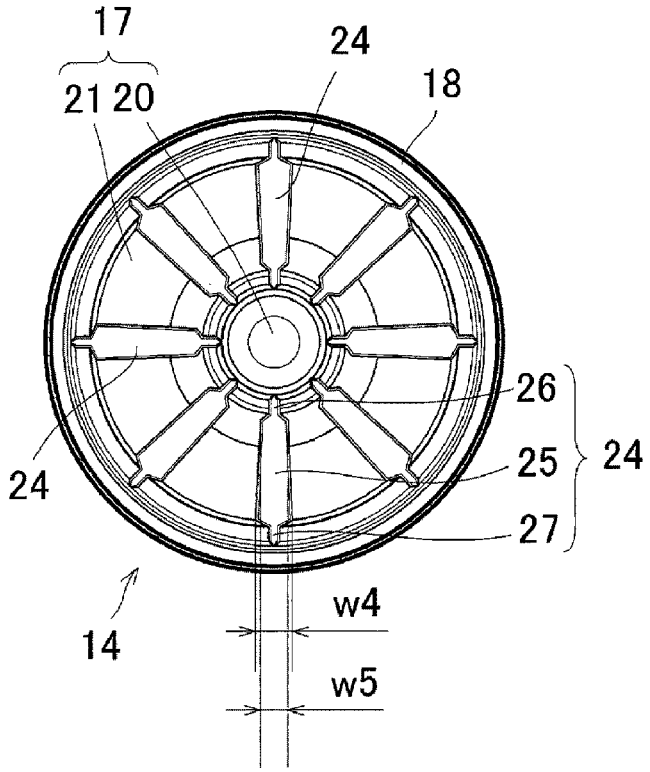
FIG. 9 is a view showing a modification of the bottom portion of the container according to the second embodiment of the present invention.

For example, although, in the above example, the main body portion 25 constituting the reinforcement portion 24 is formed to have a constant width, the width of the main body portion 25 does not need to be constant. As shown in FIG. 9, a width w4 of the main body portion 25 on the first extension portion 26 side (on the ground contact portion 18 side) may be made wider than a width w5 of the main body portion 25 on the second extension portion 27 side (on the upper surface portion 20 side). In this case, it is preferable that the width of the main body portion 25 gradually increases toward the first extension portion 26.

Further, although not shown, for example, the height of the main body portion 25 on the first extension portion 26 side (on the ground contact portion 18 side) may be higher than the height of the main body portion 25 on the second extension portion 27 side (on the upper surface portion 20 side). Also in this case, it is preferable that the height of the main body portion 25 gradually increases toward the first extension portion 26.

When the main body portion 25 has such a shape, the rigidity of the connecting portion 21 can be appropriately increased and the rigidity can be made more uniform. In this way, the deformation of the container 10 due to the internal pressure fluctuation can be efficiently suppressed.

Although the height of the rising portion 19 constituting the ground contact portion 18 is not particularly limited, it is preferable to set the height as low as possible in order to secure the rigidity of the raised bottom portion 17 when the internal pressure fluctuation occurs. Specifically, it is preferable to set the height such that the first corner portion 22 can be sufficiently formed when the internal pressure of the container 10 rises.

Furthermore, the method of manufacturing the container 10 including the reinforcement portions 24 as described above is not particularly limited, and either so-called cold parison molding method or hot parison molding method may be adopted. Here, it is preferable to change the shape of the preform depending on which molding method is adopted.

Figure 10:
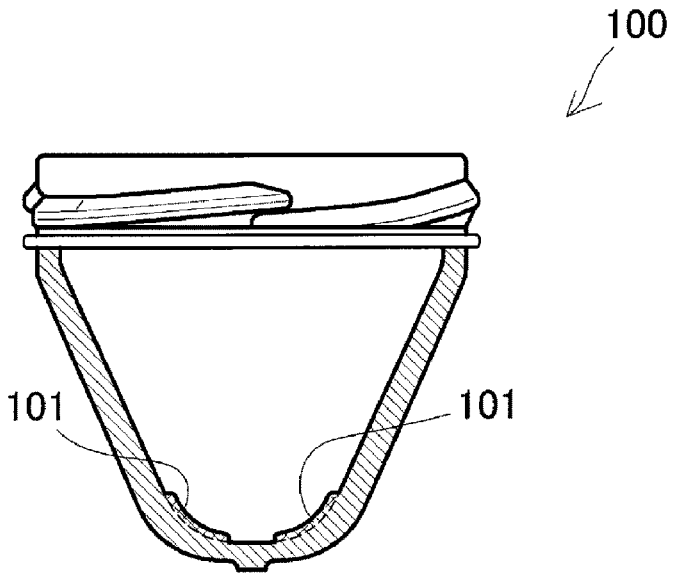
FIG. 10 is a view showing an example of a preform for molding the container according to the present invention.

When adopting the cold parison molding method, as shown in FIG. 10, convex portions 101 protruding inward from an inner surface of a preform 100 are preferably provided in portions of a bottom portion of the preform 100 which will be formed into the reinforcement portions 24. Since the portions of the preform 100 corresponding to the convex portions 101 are thicker than the other portions, the temperature of the portions is difficult to rise during blow molding. Therefore, the portions of the preform 100 corresponding to the convex portions 101 are likely to remain thicker than the other portions even after biaxial stretching and blowing. In this way, when the container 10 is formed by axially stretching and blowing the preform 100, the reinforcement portions 24 can be relatively easily formed.

Figure 11:
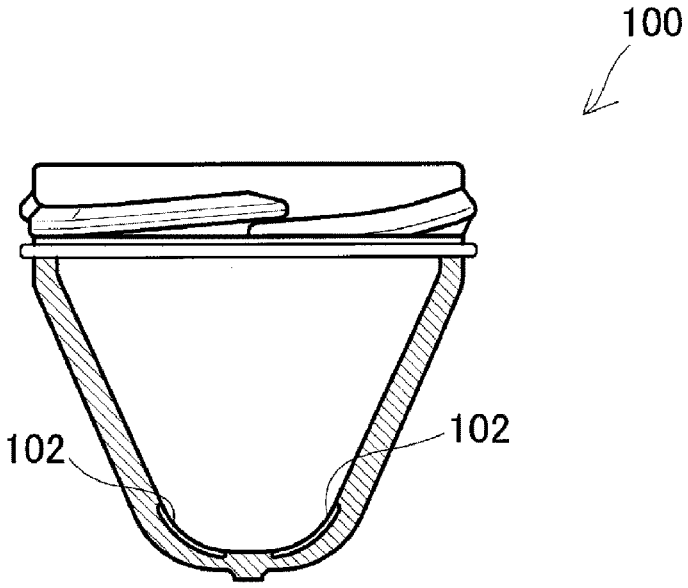
FIG. 11 is a view showing an example of a preform for molding the container according to the present invention.

On the other hand, when adopting the hot parison molding method, as shown in FIG. 11, concave portions 102 formed by recessing portions of the inner surface of the preform 100 are preferably provided in portions of the bottom portion of the preform 100 which will be formed into the reinforcement portions 24. Since the portions of the preform 100 corresponding to the concave portions 102 are thinner than the other portions, the residual heat is likely to be low. Therefore, the portions of the preform 100 corresponding to the concave portions 102 are likely to remain thicker than the other portions even after biaxial stretching and blowing. In this way, when the container 10 is formed by axially stretching and blowing the preform 100, the reinforcement portions 24 can be relatively easily formed.

Although the embodiments of the present invention have been described above, the present invention is not limited to these embodiments. The present invention can be appropriately modified without departing from the spirit thereof.

For example, although, in the above-described embodiments, the case where the internal pressure increases and becomes a positive pressure has been mainly described as the pressure fluctuation in the container, the present invention has the same effect even when the internal pressure is lowered and becomes a negative pressure.

Further, for example, although, in the above-described embodiments, the configuration in which the reinforcement portions, which are ribs, are provided to protrude from the inner surface of the raised bottom portion has been illustrated, naturally, the reinforcement portions may be provided on the outer surface of the raised bottom portion.

REFERENCE SIGNS LIST

10 Container
11 Opening
12 Neck portion
13 Body portion
14 Bottom portion
15 Screw portion
16 Concave rib
17 Raised bottom portion
18 Ground contact portion
18*a* Ground contact surface
19 Rising portion
20 Upper surface portion
20*a* Concave portion
21 Connecting portion
22 First corner portion
22*a* Depression portion
23 Second corner portion
24 Reinforcement portion
25 Main body portion
26 First extension portion
27 Second extension portion
100 Preform
101 Convex portion
102 Concave portion

The invention claimed is:

1. A container made of resin, the container comprising:
a neck portion that is opened;
a tubular body portion; and
a bottom portion sealing one end side of the body portion,
wherein the bottom portion includes a ground contact portion provided on an outer peripheral part of the body portion and a raised bottom portion provided on an inner side of the ground contact portion and configured to deform according to a change in internal pressure,
wherein the raised bottom portion includes an upper surface portion provided in a central part thereof and a connecting portion that connects the upper surface portion and the ground contact portion,
wherein at least the connecting portion of the bottom portion is provided with a reinforcement portion that extends in a radial direction of the bottom portion and reinforces the bottom portion,
wherein a first corner portion is formed between the connection portion and the ground contact portion, and a second corner portion is formed between the connection portion and the upper surface portion,
wherein the first corner portion is convex toward an inner side of the container, and the second corner portion is convex toward the inner side of the container,
wherein the reinforcement portion is a rib protruding from an inner surface of the bottom portion, and
wherein the reinforcement portion includes a main body portion provided in the connecting portion, a first extension portion continuous from the main body portion and extending to the upper surface portion, and a second extension portion continuous from the main body portion and extending to the ground contact portion.

2. The container according to claim 1,
wherein the connecting portion is formed such that an end portion of the connecting portion on the upper surface portion side is located closer to the neck portion than an end portion of the connecting portion on the ground contact portion side in a state where the internal pressure is a normal pressure.

3. The container according to claim 1,
wherein the bottom portion is provided with a plurality of the reinforcement portions which extend radially from a central part of the bottom portion toward an outer peripheral part of the bottom portion.

4. The container according to claim 1, wherein a thickness of the first extension portion and a thickness of the second extension portion are thinner than a thickness of the main body portion.

5. The container according to claim 1, wherein a width of the first extension portion and a width of the second extension portion are narrower than a width of the main body portion.

* * * * *